US005457485A

United States Patent [19]

Moriyama et al.

[11] Patent Number: 5,457,485

[45] Date of Patent: Oct. 10, 1995

[54] INK JET RECORDING APPARATUS

[75] Inventors: Jiro Moriyama; Yutaka Koizumi, both of Yokohama; Hiroto Matsuda, Ebina; Toshiaki Hirosawa, Hiratsuka; Torachika Osada, Yokohama; Hidemi Kubota, Komae, all of Japan

[73] Assignee: Canon Kabushiki Kaisha, Tokyo, Japan

[21] Appl. No.: 32,292

[22] Filed: Mar. 17, 1993

[30] Foreign Application Priority Data

Mar. 18, 1992 [JP] Japan ..... 4-061950
Mar. 10, 1993 [JP] Japan ..... 5-049129

[51] Int. Cl.[6] ..... B41J 2/19

[52] U.S. Cl. ..... 347/92; 347/93

[58] Field of Search ..... 346/1.1, 140 R; 347/30, 85, 92, 93, 94, 22, 84; 210/136, 137; 251/120, 121; 138/41, 45, 46; B41J 2/19, 2/165

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugtani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,775,871 | 10/1988 | Abe et al. | 346/140 R |
| 4,896,172 | 1/1990 | Nozawa et al. | 346/140 R |
| 4,908,636 | 3/1990 | Saito et al. | 346/140 R |
| 5,040,002 | 8/1991 | Pollacer et al. | 346/140 R |
| 5,184,641 | 2/1993 | Kuhn | 138/41 X |

FOREIGN PATENT DOCUMENTS

| | | |
|---|---|---|
| 54-056847 | 5/1979 | Japan . |
| 55-003963 | 1/1980 | Japan . |
| 58-187360 | 11/1983 | Japan . |
| 59-033153 | 2/1984 | Japan . |
| 59-123670 | 7/1984 | Japan . |
| 59-138461 | 8/1984 | Japan . |
| 60-071260 | 4/1985 | Japan . |
| 63-118260 | 5/1988 | Japan . |
| 3-016738 | 1/1991 | Japan . |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

In an ink jet recording apparatus in which a filter is placed in an ink supply route, when an ink flow is formed in the ink supply route by ink ejection during recording operations and so on, a valve does not contact firmly to the filter, but when an ejection recovery operation is performed and an ink flow velocity increases, the valve contacts firmly to the filter and covers up a part of the filter. With this structure and operation, the effective cross-section area of the filter decreases and hence, a given quantity of pressure difference is produced between the upstream side and the downstream side of the filter. As a result, bubbles unable to pass through the filter at recording operations can pass through the filter when ejection recovery operations are performed.

17 Claims, 7 Drawing Sheets

INK JET RECORDING APPARATUS

BACKGROUND OF THE INVENTION

1. Field of the Invention

The present invention relates to an ink jet recording apparatus, and specifically, an ink jet recording apparatus provided with a dust removal unit in an ink supply system used for supplying an ink from an ink tank to a recording head.

2. Description of Prior Art

In such an apparatus as represented by an ink jet recording apparatus which has a fluid route with a relatively small cross-section used for transporting fluids in it, it is required to prevent the fluid route from being plugged by dust included in the fluid, substances that come out of the fluid and even bubbles in the fluid.

In the ink jet recording apparatus, if the above-described dust or the like included in an ink fluid go into the neighborhood of the orifice of the recording head, it may occur that the orifice is plugged and that ink droplets fail to be ejected. In order to solve this problem, it is conventional that a filter for removing the fine dust, the bubbles and the like is placed anywhere in the ink supply system having a supply route from the ink tank through a common fluid reservoir and an ink path of the recording head to the orifice.

In an ink jet recording apparatus, as an example of structure for an ejection recovery operation for the recording head, there may be provided the structure in which a fresh ink fluid without bubbles and the like can be supplied to the recording head by causing circulation flow of the ink in the recording head and the ink supply system.

In an ejection recovery operation by using circulation flow of the ink fluid, the ink fluid is pressurized and driven by a pump and transported from the ink tank through a forward ink route to the recording head, and transported from the recording head through a backward ink route to the ink tank. By this circulation flow of the ink fluid, bubbles in the ink fluid in the forward and backward ink routes and even in the recording head may be returned to the ink tank and released into the atmospheric at the ink tank.

Generally, the forward and backward ink routes used for establishing the circulation flow of ink as described above are also used for supplying the ink fluid to the recording head responsive to the ink ejection from the recording head. In supplying ink fluid to the recording head when ejecting ink droplets from the recording head, it is conventional that ink fluid is supplied not by drive force developed by the pump but by using capillary action in the ink route to the recording head.

When the ink supply system between the ink tank and the recording head is used both for supplying ink fluid for ejecting ink droplets and for forming circulation flow of ink fluid, the ink supply system should satisfy the following condition, especially when the filter is installed in the ink supply system. When the circulation flow of ink fluid is formed, bubbles should return to the ink tank finally after passing through the filter, and when ink droplets are ejected in the recording operation, bubbles should not pass through the filter.

In the filter installed in the ink supply system in the prior art, however, it is often difficult to satisfy the condition described above.

FIGS. 1 and 2 are schematic cross-sectional views showing a part of an ink supply system of the prior art where the filter is installed.

In a dust removal unit of the prior art as shown in FIGS. 1 and 2, it is difficult to satisfy the above condition related to the filter. For example, in FIG. 1, ink fluid 2 supplied in the direction shown by an arrow "a" flows through an inlet tube 21 to a dust removal unit 20 having a filter 1. The ink fluid 2 passing through a fluid route 3 in the dust removal unit 20 is filtered in the filter 1 which blocks dust with a size greater than 10 μm. Thus, dust 4 in the ink fluid 2 are captured at an upstream side of the filter 1 and do not flow into a downstream side of the filter 1 into an outlet tube 22.

When the circulation flow of the ink fluid is formed by a pump in the prior art ink supply system as described above as well as when ejecting ink droplets in a recording operation, not only dust and substances come out of ink but also bubbles can not pass through the filter 1 and stay at the upstream side of the filter 1. As a result, there may be a problem in which bubbles can not fully removed even by the ejection recovery operation.

In addition, these fine-sized bubbles collect and develop into large-sized bubbles, which stay at the upstream side of the filter 1. A large-sized bubble 5 may cause the following problem. Owing to the large-sized bubble 5, the effective filtering cross-section area of the filter 1 is reduced and the flow resistance of ink fluid passing through the dust removal unit 20 is increased, so that filtering ability is lowered. An example of the dust removal unit which solves this problem of the dust removal unit 20, is shown in FIG. 2. In FIG. 2, like parts as shown in FIG. 1 have like reference numerals. In this unit, as the overall cross-section area of the filter 1 is made to be large enough so that the filtering ability of the filter 1 is not reduced even when bubbles are captured within the filter 1. However, from experiments, it is known that the size of the bubble captured at the upper-stream side of the filter 1 even increases if bubbles are contained in the ink fluid 2 passing through the dust removal unit 20 having a filter 1 with larger cross-section area, and that the effective filtering cross-section area of the filter 1 can not increase in proportion as the overall cross-section area of the filter 1 increases.

In addition, the size of the dust removal unit shown in FIG. 2 becomes larger than the size of the dust removal unit shown in FIG. 1. This goes against the requirement for establishing the ink jet recording apparatus with a small size. Furthermore, a cost of materials used for the filter which can capture fine-sized particles is relatively high, and then, the larger cross-section of the filter 1 brings a disadvantage for cost reduction. Filters used in prior art dust removal units can not satisfy conditions both in the recording operation and the recovery operation with circulation ink flow, and the filter efficiency may decrease as the apparatus runs longer.

SUMMARY OF THE INVENTION

An object of the present invention is to provide an ink jet recording apparatus which can prevent the ink ejection failure caused by bubbles contained in ink fluid when ejecting ink for recording operations, does not reduce the filter ability even under an existence of bubbles, and can remove bubbles effectively in ejection recovery operations.

The present invention is based on the idea that, in the ejection recovery operation, relatively fine-sized bubbles can pass through the filter so that large-sized bubble may not be formed and so that, in the recording operation, such fine-sized bubbles can not pass through the filter.

In an experiment using the prior art ink supply system as shown in FIG. 1 in which the overall cross-section area of the filter 1 is S $mm^2$, the shape of the mesh of the filter is a square with 8 μm size, and a pressure difference between the upstream side and the downstream side of the filter 1 is produced. As shown below, in examination three filters having different cross-section areas are used respectively, the pressure difference is varied gradually, and the pressure difference Pt (atm) at which fine-sized bubbles can pass through the filter 1 is measured.

| | | | | |
|---|---|---|---|---|
| S | ($mm^2$) | 27 | 70 | 165 |
| Pt | (atm) | 0.15 | 0.15 | 0.19 |
| Pc | (atm) | 0.25 | 0.25 | 0.26 |

Pc is the maximum pressure at which a meniscus of ink fluid 2 can be formed in the filter 1, and which is calculated by assuming that the contact angle defined between the ink fluid 2 and the filter 1 is zero.

According to the above experimental result, in the prior art dust removal unit as shown in FIG. 1, it is proved that a given quantity of pressure difference between the upstream side and the downstream side of the filter 1 Pt, should be produced in order to make fine-sized bubbles staying around the filter 1 pass through the filter 1, and that the given quantity of pressure difference does not depend upon the overall cross-section of the filter, S.

In a first aspect of the present invention, there is provided an ink jet recording apparatus using an ink tank storing an ink fluid supplied to a recording head for ejecting an ink fluid, and an ink supply route connected between the recording head and the ink tank and at least used for transporting an ink fluid from the ink tank to the recording head; and performing recording by ejecting an ink fluid from the recording head onto a recording medium, the apparatus comprising:

a filter placed in the ink supply route;

a valve being capable of covering a part of the filter and of contacting firmly to the filter; and a contacting means for contacting firmly the valve on the filter.

Here, the contacting means may be formed by an ink fluid flow directing from the ink tank to the recording head in the ink supply route.

An ink jet recording apparatus may further comprise:

a pressurizing means for generating the ink fluid flow.

The pressurizing means may generate the ink fluid flow when the recording head is in an ejection recovery operation.

An ink jet recording apparatus may further comprise:

a suction means for generating the ink fluid flow.

The suction means may generate the ink fluid flow when the recording head is in an ejection recovery operation.

The contacting means may be formed by forming a part of the valve by using a piezo-electric device and by deforming the valve by supplying an electric power to the piezo-electric device.

The recording head may generate a bubble in an ink fluid by using thermal energy and ejects an ink fluid in responsive to generation of the bubble.

In a second aspect of the present invention, there is provided an ink jet recording head having an orifice for ejecting an ink fluid comprising:

an ink accepting part for accepting an ink fluid used for the ink ejection;

an ink route extended from the ink accepting part to the orifice;

a filter placed in the ink route; and a valve being capable of covering a part of the filter and of contacting firmly to the filter, the valve contacting firmly the filter by an ink fluid flow passing through the ink route with a flow velocity greater than a given flow velocity.

The recording head may generate a bubble in an ink fluid by using thermal energy and ejects an ink fluid in responsive to generation of the bubble.

In a third aspect of the present invention, there is provided an ink jet unit having a single body containing an ink jet recording head having an orifice for ejecting an ink fluid and an ink tank storing an ink fluid supplied to the recording head, the unit comprising:

an ink route extended from the ink tank to the orifice;

a filter placed in the ink route; and a valve being capable of covering a part of the filter and of contacting firmly to the filter, the valve contacting firmly the filter by an ink fluid flow passing through the ink route with a flow velocity greater than a given flow velocity.

The recording head may generate a bubble in an ink fluid by using thermal energy and ejects an ink fluid in responsive to generation of the bubble.

In a fourth aspect of the present invention, there is provided a method for performing ejection recovery operation under pressure in an ink jet recording apparatus in which an ink fluid is supplied from an ink storage part for storing an ink fluid to a recording head having a plurality of orifices for ejecting an ink fluid through an ink supply route, and recording is performed by ejecting an ink fluid from the recording head onto a recording medium, the method comprising the step of:

reducing an ink flowing area of a filter placed in the ink supply route when the ejection recovery operation is performed, the area at the ejection recovery operation being smaller than an ink flowing area when the recording being performed.

A pressure difference between an upstream side and a downstream side of the filter may be increased, by the reduction of the ink flowing area, the pressure difference being greater than that when the recording being performed.

The recording head may generate a bubble in an ink fluid by using thermal energy and ejects an ink fluid responsive to generation of the bubble.

The above and other objects, effects, features and advantages of the present invention will become more apparent from the following description of embodiments thereof taken in conjunction with the accompanying drawings.

DESCRIPTION OF PREFERRED EMBODIMENT

As will be described, these and other features of the present invention and embodiments of it are more fully described in a detailed description and with the accompanying drawings.

(Embodiment 1)

Figure 3:
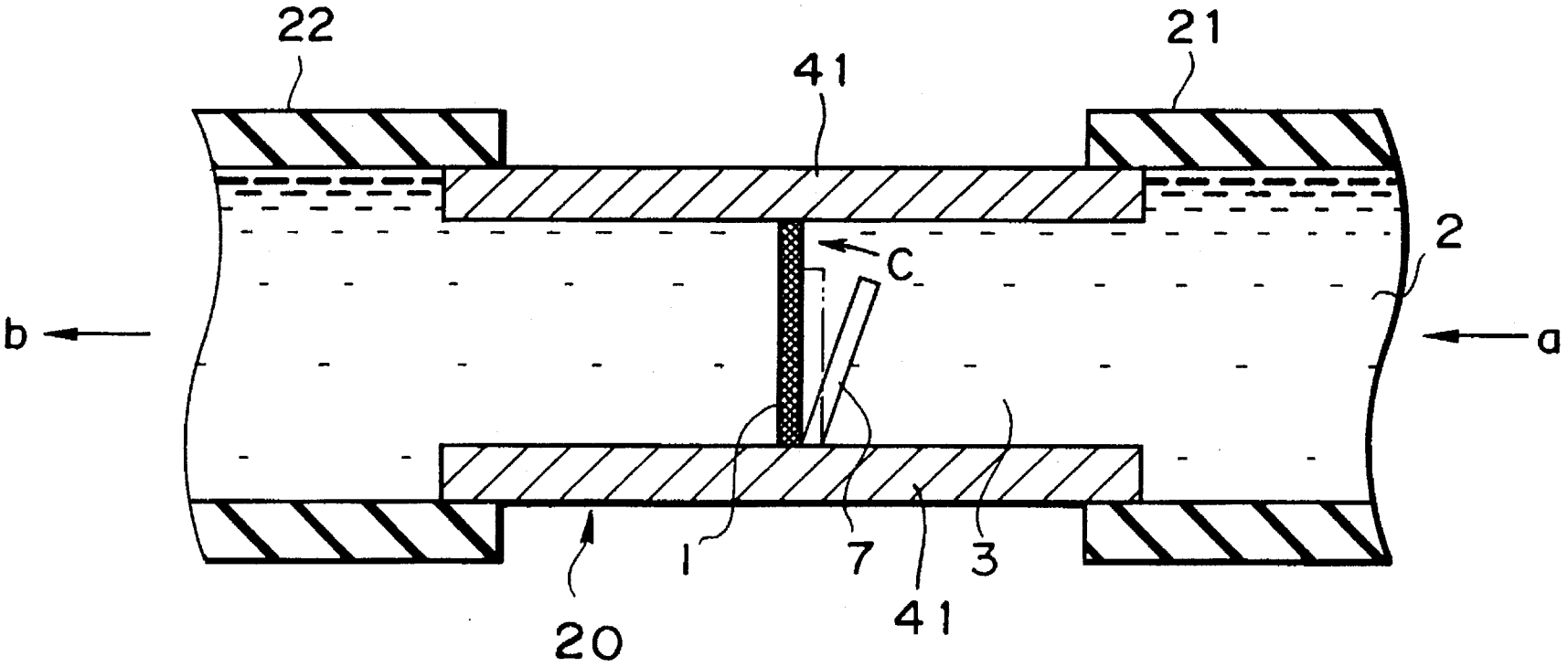
FIG. 3 is a schematically cross-sectional view showing a dust removal unit of the first embodiment of the present invention.

FIG. 3 is a schematically cross-sectional view showing a part of an ink supply system of the first embodiment of the present invention.

Figure 1:
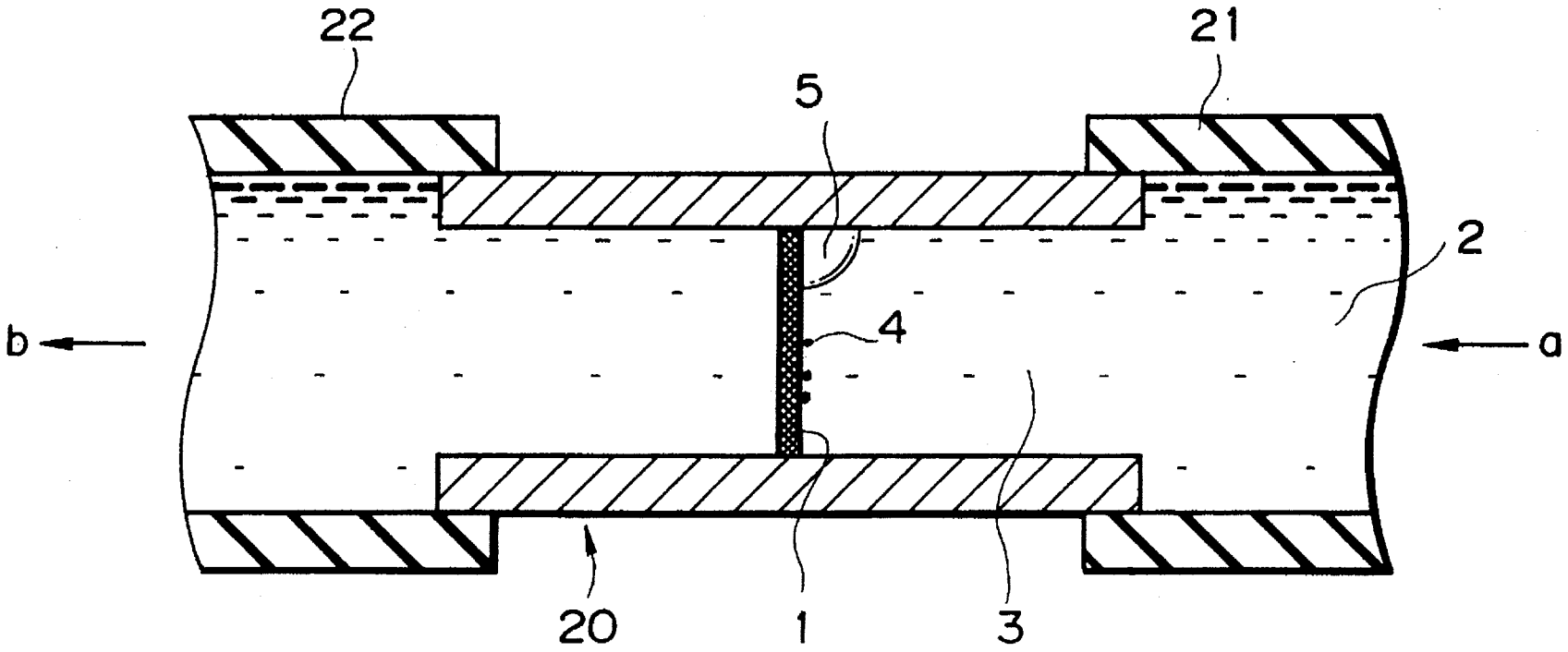
FIG. 1 (PRIOR ART)
FIG. 1 is a schematically cross-sectional view showing an example of the prior art of a dust removal unit used in an ink supply system in an ink jet recording apparatus.
Figure 2:
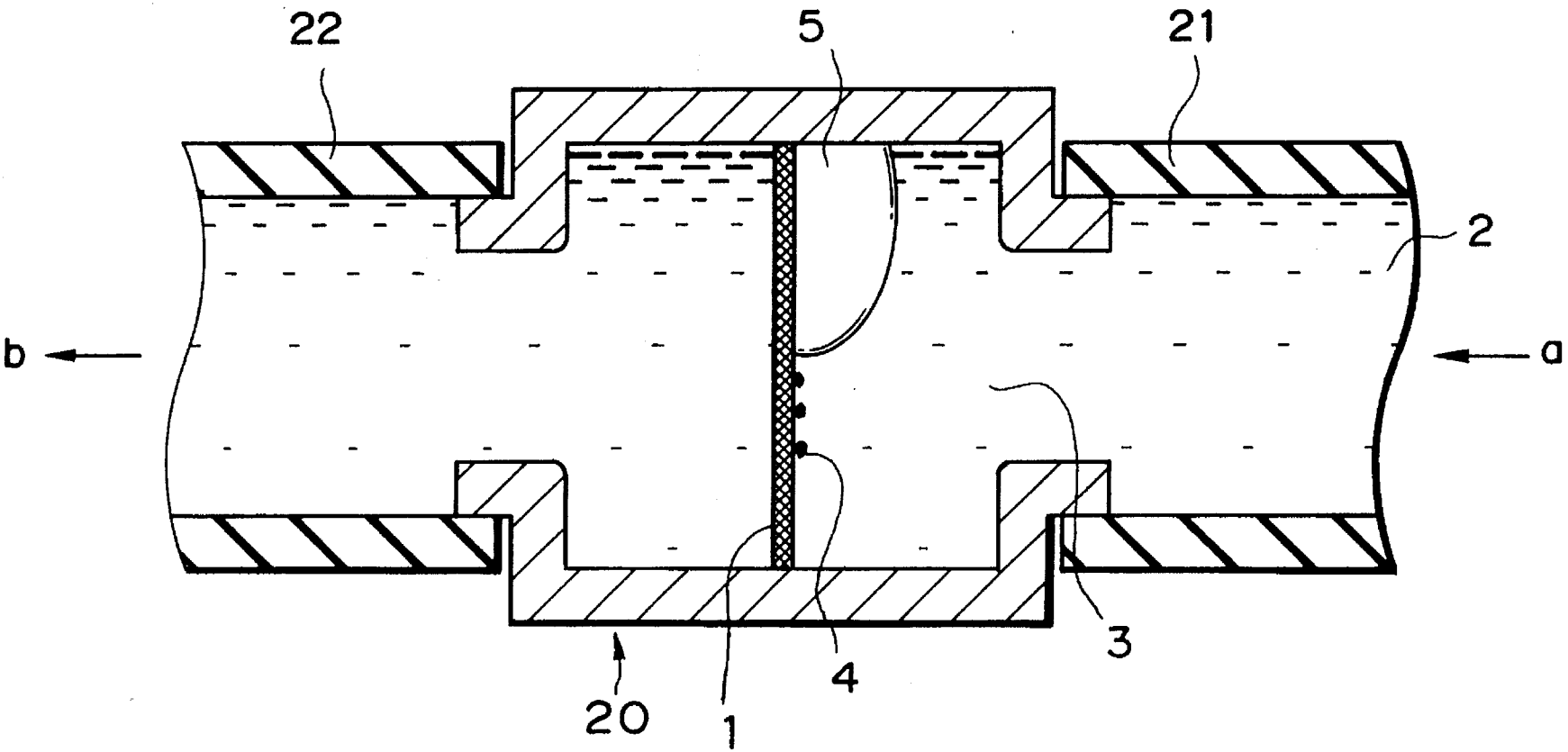
FIG. 2 (PRIOR ART)
FIG. 2 is a schematically cross-sectional view showing another example of the prior art a dust removal unit used in an ink supply system in an ink jet recording apparatus.

A filter 1 is placed so as to cover the whole part of the cross-section of a fluid route 3 and is used for preventing fine dust and substances that come out of ink fluid from passing through the fluid route 3. The filters shown in FIGS. 1 and 2 may be used as the filter 1 of this embodiment. A valve 7 is placed to be adjacent to the filter 1, one end part of which is linked with a part of a fluid route wall 41 so as to rotate freely in a direction C shown by an arrow in FIG. 3. An ink fluid 2 flows through an inlet tube 21 toward the filter 1 in the direction shown by the arrow "a" and, after passing through the filter 1, the ink fluid 2 flows out through the outlet tube 22 in the direction shown by the arrow "b".

In the ink supply system having such a dust removal unit as shown in FIG. 3, during the ink ejection operation which is performed at recording or the like, the ink fluid 2 flows slowly in the directions "a" and "b". By this slow ink flow, the valve 7 rotates slightly to the filter 1 and stays at the position shown by the solid line in FIG. 3 in which the valve 7 does not contact firmly to the filter 1. In this situation where the flow rate of the ink is small enough, the effective cross-section area of the filter is equivalent to the cross-section area defined without the valve 7. In this case, the pressure difference produced between the upstream side and the downstream side of filter is extremely small and hence, small-sized fine bubbles can not pass through the filter 1.

Next, what is described is the action of the filter 1 and the valve 7 at the ejection recovery operation.

In this case, the ink fluid 2 flows faster in the directions "a" and "b" by the pressure produced by a pump so that the valve 7 moves toward the filter 1 and contacts firmly onto the filter 1, in which a part of the filter 1 is covered with the valve 7. In this case, the effective cross-section area of the filter 1 is about one fifth of the whole cross-section area of the filter 1 without the valve 7. Due to the reduction of the effective cross-section of the filter 1 and the relatively fast ink flow, a relatively large pressure difference is produced between both sides of filter 1, and hence, bubbles pass through the filter. As a result, in the recovery operation, the bubbles can be removed effectively.

Figure 4:
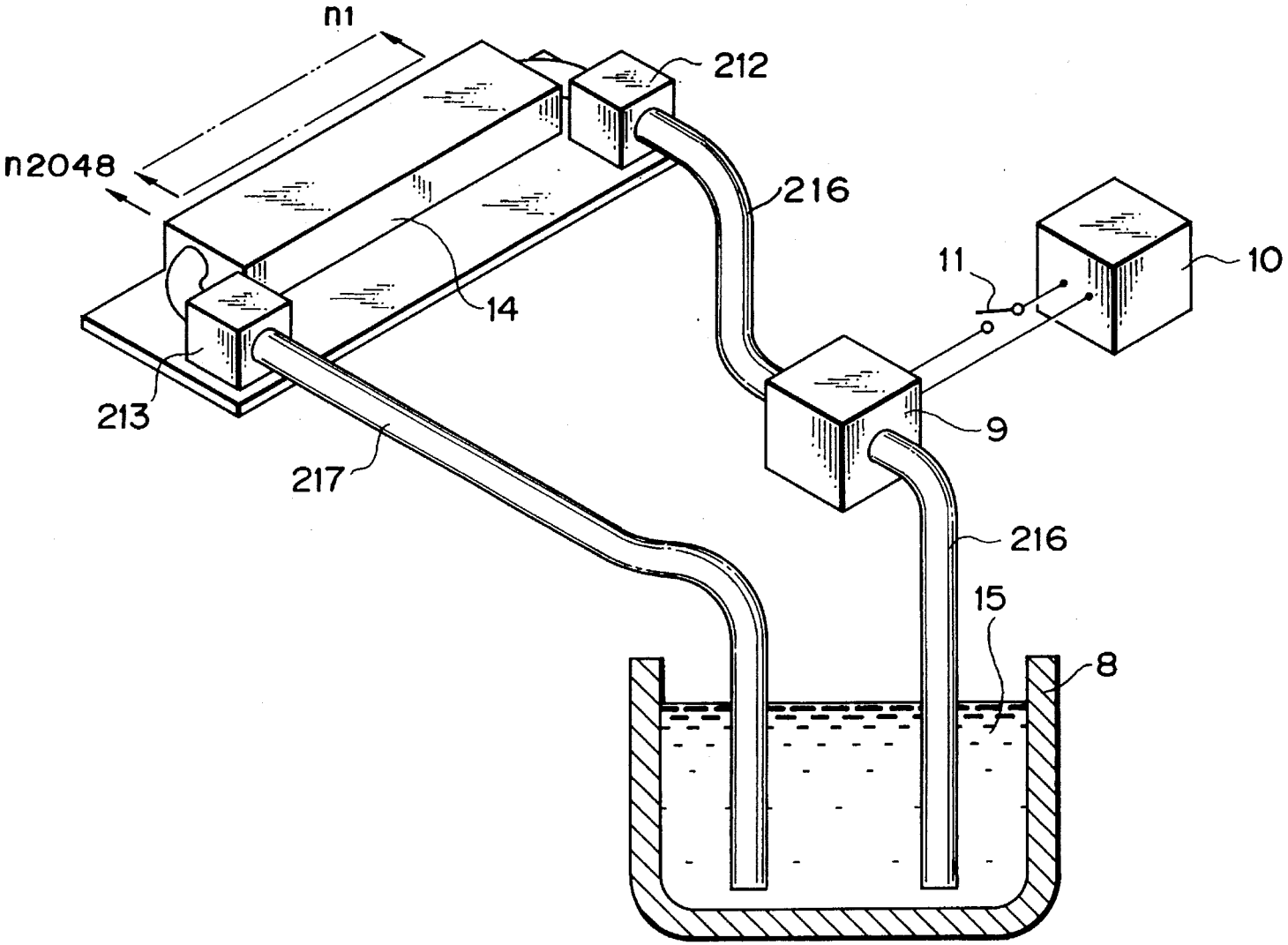
FIG. 4 is a schematically perspective view showing an ink supply system in an ink jet recording apparatus using the dust removal unit shown in FIG. 3.

FIG. 4 is a schematically perspective view showing an overall picture of the ink supply system, at a part of which the dust removal unit shown in FIG. 3 is placed.

The ink supply system contains a recording head 14 as a part of the system. The maximum quantity of ink flow in the recording operation, $Q_{dmax}$, is defined below. Suppose that the volume of a single ink droplet ejected by the recording head 14 is 200 pl (picoliter) and that the ink droplets are ejected from all the 2048 orifices with an ejection frequency 400 Hz , $Q_{dmax}$=200 pl×400 Hz×2048=0.16 ml/sec, which means that an ink fluid of 0.16 ml is ejected a second and this ejection quantity coincides with the maximum quantity of ink flow.

In the recording operation, the ink fluid supplied from the ink tank 8 to the recording head 14 passes through the tube 216 having a gear pump 9 and the tube 217. The ratio of the quantity of ink fluids supplied through the tube 216 to the tube 217 is 3:7. Therefore, the flow rates of the ink fluids passing through the tubes 216 and 217, $Q_{d1}$ and $Q_{d2}$, are approximately 0.05. ml/sec and 0.11 ml/sec, respectively. The reason why the quantity of the ink fluid supplied through the tube 216 is smaller is that the resistance of the pump 9 to the ink fluid flow exists.

An ink fluid 15 is stored in a ink tank 8. The gear pump 9 having a motor (not shown) accepts an electric power for driving the pump from the electric power supply 10. The recording head 14 has 2048 orifices, in which orifices n1 to n2048 are arranged in a vertical line and eject ink droplets in the direction shown by an arrow in FIG. 4 by the head drive circuit not shown in responsive to the recording data in the recording operation. A couple of dust removal units 212 and 213 similar to that shown in FIG. 3 are placed at both ends of the recording head 14.

In the ink jet recording apparatus of this embodiment, the ejection recovery operation by pressurization by the pump, that is, the ejection recovery operation by the circulation ink fluid flow, is performed just before starting the recording operation after turning on the recording apparatus, and when it is estimated that bubbles are localized in the ink route after the recording operation continues so long. In this way, the ejection recovery operation is performed at an arbitrary time as one of sequential operations of the ink jet recording apparatus. In the following, referring to FIG. 4, details of the pressurizing recovery operation will be described.

At first, when the switch 11 is turned on, the gear pump 9 starts to operate for transporting the ink fluid 15 through the tube 216 toward the dust removal unit 212. As the ink fluid 15 is pressurized by the gear pump 9, the effective cross-section area of the filter 1 is about one fifth of the cross-section area defined when the valve 7 does not exist so that the pressure difference between both side of the filter 1 is produced significantly, and hence, bubbles can pass through the filter 1. The bubbles return to the ink tank 8 after traveling through the recording head 14, the dust removal unit 213 and the tube 217. In the dust removal unit 213, bubbles can also pass through the filter 1 by such a similar action of the valve 7 as in the dust removal unit 212. Therefore, in the dust removal unit 213, the valve 7 is placed near the recording head where the valve 7 is positioned at the upstream side of the filter when the ejection recovery operation.

The bubbles contained in the circulation flow of the ink fluid 15 are released outside the ink fluid and released into the atmospheric air at the ink tank 8, and hence the bubbles in the ink fluid are removed.

The phenomena in which the bubbles can pass through the filter can be explained in the following. As the flow rate of the ink when the ink fluid is pressurized is larger than the flow rate when the recording operation is performed, the velocity of the ink flow increases in the recovery operation, and the valve 7 in the dust removal unit 212 contacts firmly onto the filter 1 and covers up a part of the filter 1. As a result, the effective cross-section area of the fluid route through the filter decreases and the pressure difference between the upstream side and the downstream side of the filter 1 is produced. This pressure difference, designated by P2, is 0.3 atm or more. With this pressure difference the bubbles can pass through the filter 1 having a mesh with about 8 μm size at the dust removal unit 212, and thus, the bubbles go back to the ink tank 8 together with the ink and are released in the atmospheric air.

Until the recovery operation described above, the pump 9 is not operated and hence, the valve 7 opens. In the recording operation, the valve 7 also opens. In those situations, the flow rate of the ink fluid is relatively small, and the filters in the dust removal units 212 and 213 are not covered with the valves, respectively, and the pressure difference produced between the upstream side and the down stream side of the filter 1 is about 0.1 atm or less. In this case, fine sized bubbles can not pass through the filter. Thus, the ejection of ink droplets is stably performed without introducing bubbles into a recording head side.

In the above explanation, though it is assumed that $P2 \simeq 0.3$ atm and $P1 \simeq 0.1$ atm, P1 and P2 can be determined arbitrarily in the actual design of the dust removal unit by estimating the size of the mesh of the filter and the dynamics of the valve and its safety factor.

The filter 1 can be removable from the dust removal unit so as to be cleaned or exchanged in case that a large amount of fine dust are put into the filter and the filtering capacity of the filter is reduced.

(Embodiment 2)

Figure 5:
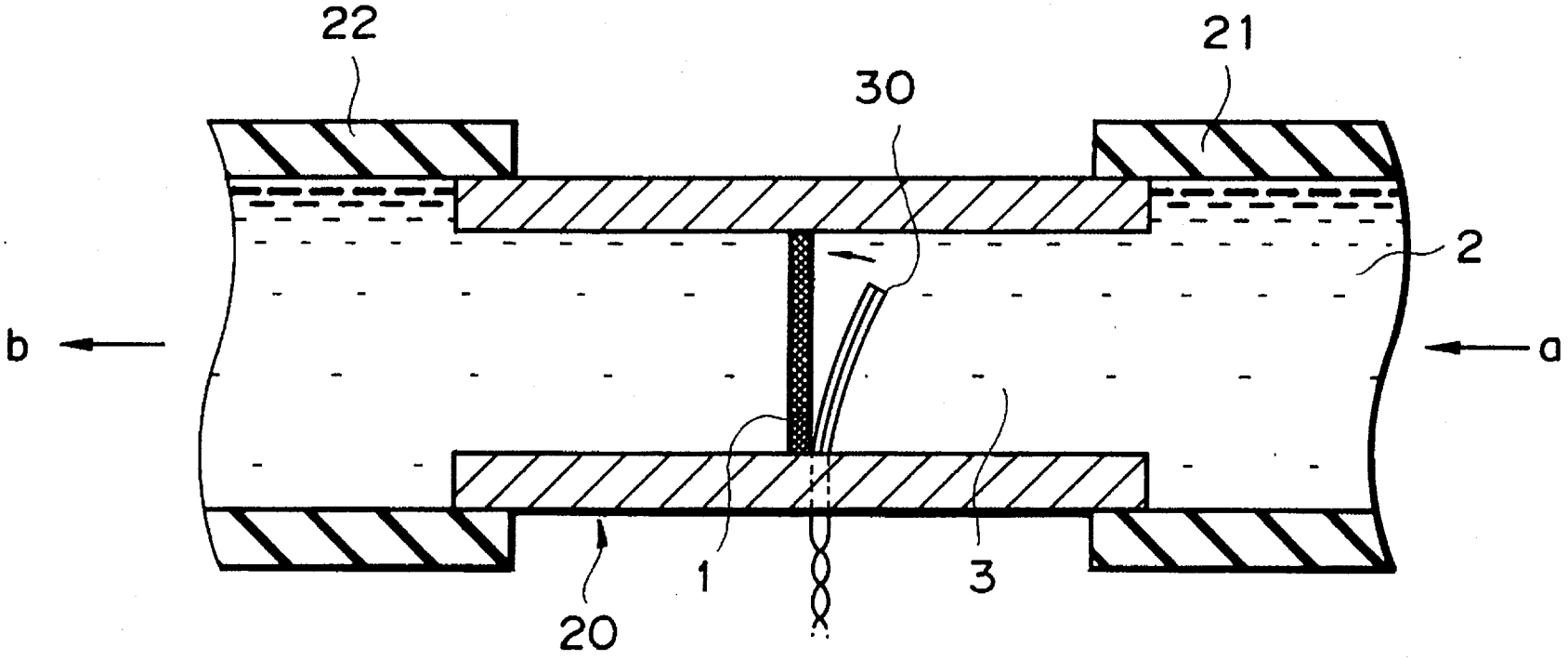
FIG. 5 is a schematically cross-sectional view showing a dust removal unit of the second embodiment of the present invention.

FIG. 5 is a schematically cross-sectional view showing a dust removal unit of the second embodiment of the present invention.

In this embodiment, an active valve 30 is placed so as to be deformed by an external drive system not shown in FIG. 5. An piezo-electric device can be used for this active valve 30. In the case that there is almost no difference between the flow rate of the ink fluid at the recording operation and the flow rate of the ink fluid at the recovery operation, the active valve 30 can be deformed by the drive system at the recovery operation in order to cover up a part of the filter and to reduce the cross-section area of the ink flow route, and thus, a pressure difference can be produced between the upstream side and the downstream side of the filter 1.

(Embodiment 3)

Figure 6:
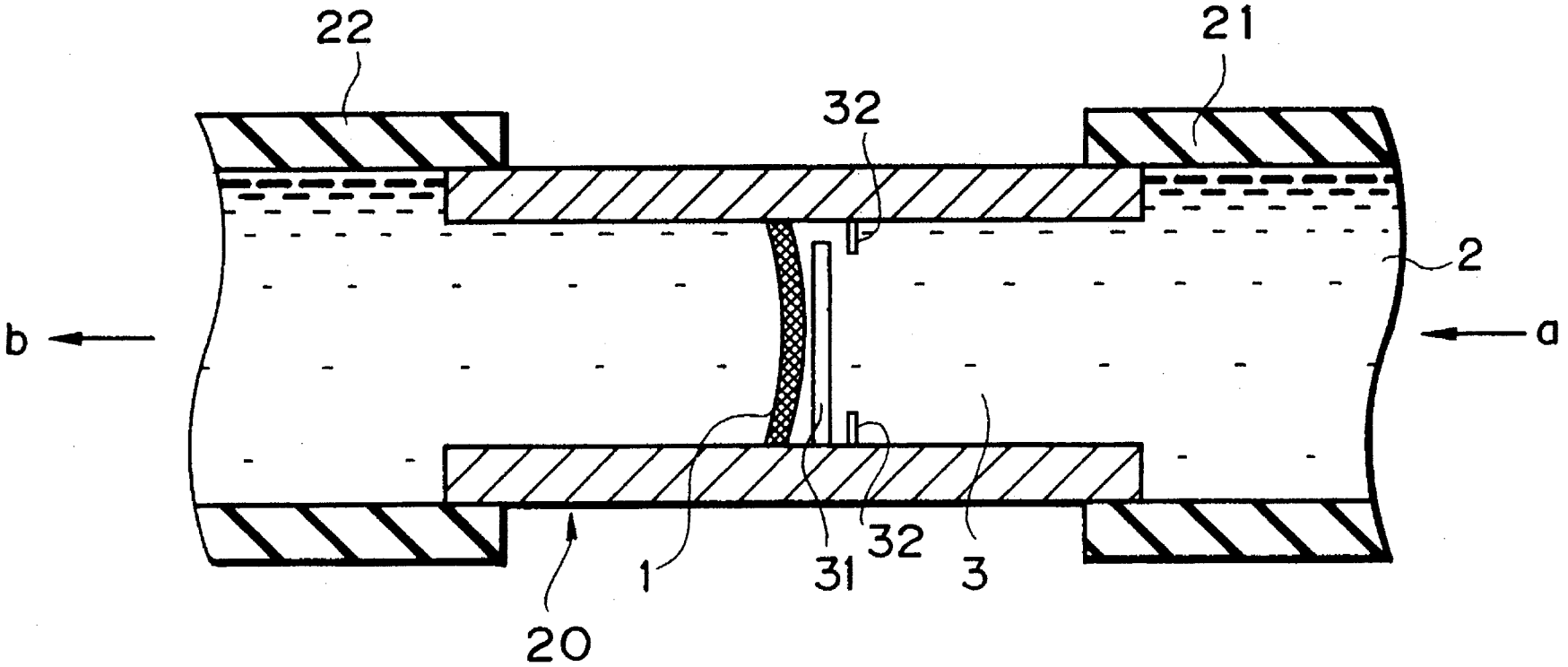
FIG. 6 is a schematically cross-sectional view showing a dust removal unit of the third embodiment of the present invention.

FIG. 6 is a schematically cross-sectional view showing a dust removal unit of the third embodiment of the present invention. In FIG. 6, like parts as shown in FIG. 3 have like reference numerals and their explanations are not repeated below.

In FIG. 6, a valve 31 is an passive valve moved responsive to the ink flow and is not fixed on the inner wall of the ink route in the dust removal unit. A stopper 32 is fixed on the inner wall of the ink route. By the stopper 32, the valve 31 can be guided to be close enough to the filter 1. In this structure, either of the filter 1 or the valve 31 is required to be formed in a curved shape. In this embodiment shown in FIG. 6, the filter 1 is formed in a curved shape. The ink flows from the inlet tube 21 toward the outlet tube 22.

As the ink fluid flows relatively slowly at the recording operation, the pressure difference produced between the upstream side and the downstream side of the passive valve 31 is small. Therefore, the valve 31 does not contact firmly onto the filter 1 but moves between the filter 1 and the stopper 32. With the quantity of the pressure difference produced in this case, bubbles can not pass through the filter 1.

On the other hand, at the recovery operation, the ink fluid flows relatively faster, the pressure difference produced between the upstream side and the downstream side of the passive valve 31 is large, and hence the valve 31 contacts firmly onto the filter 1. In such a case, the effective cross section area of the filter 1 for the ink fluid flow is reduced, and hence, a pressure difference which is large enough to make the bubbles pass through the filter 1 can be provided between the upstream side and the downstream side of the filter 1.

(Embodiment 4)

Figure 7B:
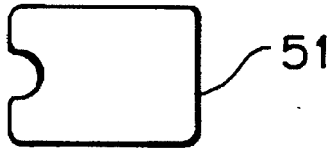
FIG. 7B is a schematically plan view of a valve shown in the A–B cross-section line in FIG. 7A.
Figure 7A:
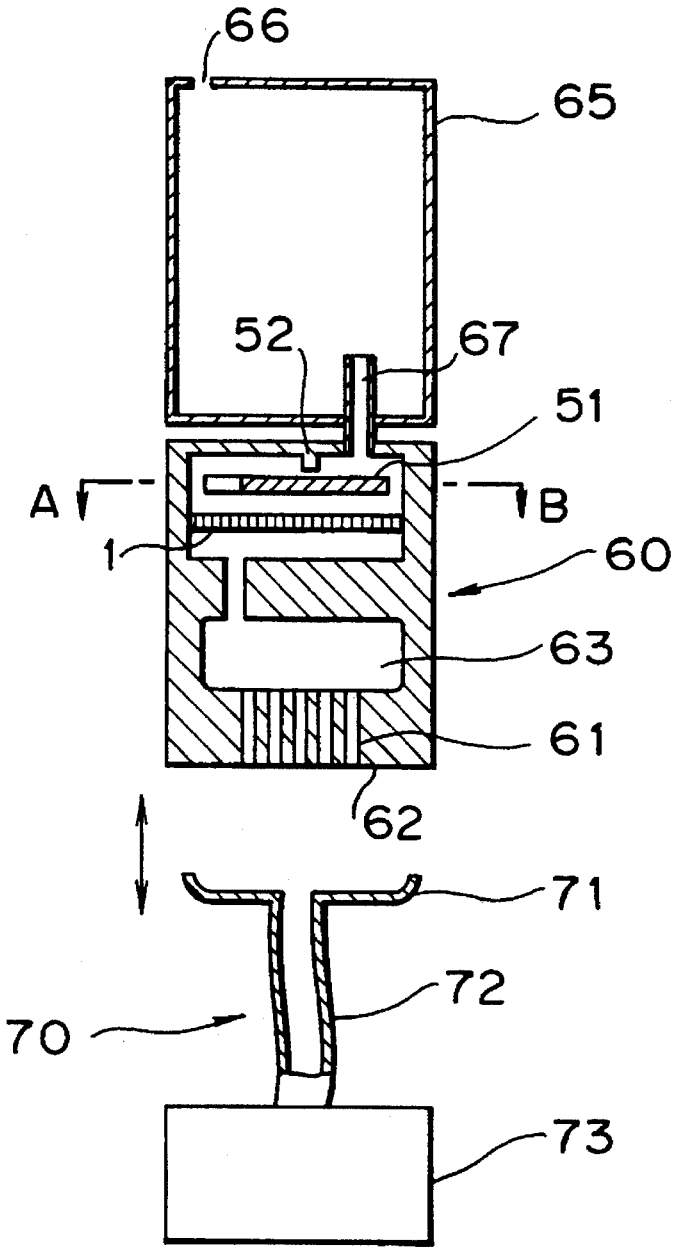
FIG. 7A is a schematically cross-sectional view showing a single unit accommodating an ink tank and a recording head having a dust removal unit, and an ejection recovery unit of the fourth embodiment of the present invention.

FIG. 7A is a schematically cross-sectional view showing a single unit accommodating an ink tank and a recording head having the dust removal unit, and an ejection recovery unit of the fourth embodiment of the present invention, and FIG. 7B is a schematically plan view of a valve shown in the A–B cross-section FIG. 7A.

The recording head in this embodiment is a serial type recording head, with which the recording operation is performed by ejecting ink droplets onto a recording sheet responsive to the movement of the recording head. In such a recording apparatus, it is general that an ejection recovery unit used for the recovery operations and so on is placed at the home position of the recording head.

FIG. 7A shows a state in which a recording head 60 is placed at the home position and faces against a cap 71 of a recovery unit 70. The recording head 60 together with a ink tank 65 is mounted on a carriage not shown so as to be movable at the recording operation. The ink is supplied from the ink tank 65 to the recording head 60 through a connection pipe 67. The recording head 60 has a plurality of orifices 62 and a plurality of ink paths 63 each of which is connected to each of the orifices 62 respectively, and furthermore has a common ink reservoir 63 to which all the ink paths 63 are connected commonly. The common ink reservoir 63 and the connection pipe 67 are connected to each other through a dust removal chamber in this embodiment. In each of the ink paths 63, an electro-thermal conversion device (not shown) generating thermal energy used for ejecting ink droplets is mounted.

A filter 1 occupying the whole part of the cross-section of the fluid route is mounted in the dust removal chamber, and a valve 51 is placed so as to be moved freely at the upstream side of the filter 1. The valve 51 has a U-shaped cut part at one edge of it so that the ink fluid and bubbles can pass through the valve 51 when the valve 51 contacts firmly onto the filter 1.

When ejecting ink droplets in the recording operation, as the velocity of the ink fluid flow from the ink tank 65 to the common fluid reservoir is relatively small, the valve 51 does not contact firmly onto the filter 1.

On the other hand, at the recovery operation, the surface of the recording head 60 on which orifices 62 are formed is covered with the cap 71 of the recovery unit 70, and the ink fluid in the recording head 60 is sucked by a suction pump 73 through the orifices 62. The velocity of the ink flow at the suction operation by the suction pump is relatively large, and hence, the valve 51 contacts firmly onto the filter 1, and consequently, the effective cross-section area of the fluid route through the filter is reduced. As a result, a given quantity of pressure difference is produced between the upstream side and the downstream of the filter 1, and bubbles can pass through the filter 1. The bubbles passing through the filter 1 are collected together with the sucked ink and discharged from the recovery unit 70 to a predetermined position.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313, 124 be adopted to achieve better recording.

U.S. Pat. Nos. 4,558,333 and 4,45 9,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.– 70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet recording apparatus using an ink jet recording head for ejecting an ink fluid in a recording operation and an ink tank for storing the ink fluid for supply to the recording head, said apparatus comprising:

an ink flow path connected between the ink jet recording head and the ink tank for supplying the ink fluid to the ink jet recording head;

a filter in said ink flow path, the ink fluid flowing through said filter in the recording operation and in a recovery operation; and an area reducing member for contacting said filter, wherein said area reducing member is in contact with said filter in the recovery operation to provide a reduced fluid-flow area of said filter and thereby change the pressure of the ink fluid flow therethrough.

2. An ink jet recording apparatus as claimed in claim 1, wherein said area reducing member comprises a valve for contacting said filter to make the ink fluid flow faster therethrough.

3. An ink jet recording apparatus as claimed in claim 2, further comprising pressurizing means for generating faster ink fluid flow in said ink flow path.

4. An ink jet recording apparatus as claimed in claim 3, wherein said pressurizing means generates the faster ink fluid flow in the recovery operation.

5. An ink jet recording apparatus as claimed in claim 2, further comprising suction means for generating faster ink fluid flow in said ink flow path.

6. An ink jet recording apparatus as claimed in claim 5, wherein said suction means generates the faster ink fluid flow in the recovery operation.

7. An ink jet recording apparatus as claimed in claim 2, wherein said valve includes a piezo-electric device deformed by supplying electric power thereto.

8. An ink jet recording apparatus as claimed in claim 1, wherein the recording head generates a bubble in the ink fluid by using thermal energy and ejects ink fluid responsive to generation of the bubble.

9. An ink jet recording head for ejecting in a recording operation an ink fluid supplied from an ink tank, said ink jet recording head comprising:

an ink flow path for connection to the ink tank for supplying ink fluid to said ink jet recording head;

a filter in said ink flow path, the ink fluid flowing through said filter in the recording operation and in a recovery operation; and an area reducing member for contacting said filter, wherein said area reducing member is in contact with said filter in the recovery operation to provide a reduced fluid-flow area of said filter and thereby change the pressure of the ink fluid flow therethrough.

10. An ink jet recording head as claimed in claim 9, wherein said recording head generates a bubble in the ink fluid by using thermal energy and ejects ink fluid responsive to generation of the bubble.

11. An ink jet recording head as claimed in claim 9, wherein said area reducing member includes a valve.

12. An ink jet having an ink jet recording head for ejecting an ink fluid in a recording operation and an ink tank for storing the ink fluid for supply to said recording head, said unit comprising:

an ink flow path connected between said ink jet recording head and said ink tank for supplying ink fluid to said ink jet recording head;

a filter in said ink flow path, the ink fluid flowing through said filter in the recording operation and in a recovery operation; and an area reducing member for contacting said filter, wherein said area reducing member is in contact with said filter in the recovery operation to provide a reduced fluid-flow area of said filter and thereby change the pressure of the ink fluid flow therethrough.

13. An ink jet unit as claimed in claim 12, wherein said recording head generates a bubble in the ink fluid by using thermal energy and ejects an ink fluid responsive to generation of the bubble.

14. An ink jet unit as claimed in claim 12, wherein said area reducing member includes a valve.

15. A method for performing a recovery operation in an ink jet recording apparatus in which an ink fluid is supplied through an ink flow path from an ink storage part to a recording head, said recording head ejecting the ink fluid in a recording operation, said method comprising the steps of:

providing a filter in the ink fluid flow path, the ink fluid flowing through said filter in the recording operation and the recovery operation; and reducing a fluid-flow area of the filter when the recovery operation is performed to increase the velocity of the ink fluid flow through the filter.

16. A method as claimed in claim 15, wherein a pressure difference between an upstream side and a downstream side of said filter is increased by the reduction of the fluid flow area, the increased pressure difference being greater than a pressure difference in the recording operation.

17. A method as claimed in claim 16, wherein the recording head generates a bubble in the ink fluid by using thermal energy and ejects ink fluid responsive to generation of the bubble.

* * * * *

UNITED STATES PATENT AND TRADEMARK OFFICE

CERTIFICATE OF CORRECTION

PATENT NO. : 5,457,485

DATED : October 10, 1995

INVENTOR(S) : Jiro Moriyama et al.

It is certified that error appears in the above-identified patent and that said Letters Patent is hereby corrected as shown below:

COLUMN 1

Line 43, "atmospheric" should read --atmosphere--.

COLUMN 2

Line 10, "are" should read --is--
Line 11, "do" should read --does--
Line 14, "above" should read --above,--
Line 19, "can not" should read --cannot be--
Line 31, "as" should be deleted
Line 35, "upper-stream" should read --upstream--
Line 46, "a" should read --the-- and "the" should read --a--
Line 65, "that" should read --that a--.

COLUMN 3

Line 6, "in examination" should be deleted
Line 44, "by" should read --by directing--
Line 45, "directing" should be deleted
Line 60, "in" should be deleted.

UNITED STATES PATENT AND TRADEMARK OFFICE

CERTIFICATE OF CORRECTION

PATENT NO. : 5,457,485

DATED : October 10, 1995

INVENTOR(S) : Jiro Moriyama et al.

It is certified that error appears in the above-identified patent and that said Letters Patent is hereby corrected as shown below:

COLUMN 4

Line 10, "in" should be deleted
Line 26, "in" should be deleted
Line 41, "being" should read --is being--
Line 45, "being" should read --is being--
Line 56, "schematically" should read --schematic--
Line 59, "schematically" should read --schematic--
Line 60, "art" should read --art of--
Line 62, "schematically" should read --schematic--
Line 65, "schematically" should read --schematic--.

COLUMN 5

Line 2, "schematically" should read --schematic--
Line 5, "schematically" should read --schematic--
Line 8, "schematically" should read --schematic--
Line 12, "schematically" should read --schematic--
Line 15, "PREFERRED" should read --THE PREFERRED--
Line 24, "schematically" should read --schematic--
Line 50, "filter" should read --the filter--
Line 61, "cross-section" should read --cross-section area--
Line 66, "schematically" should read --schematic--.

UNITED STATES PATENT AND TRADEMARK OFFICE

CERTIFICATE OF CORRECTION

PATENT NO. : 5,457,485

DATED : October 10, 1995

INVENTOR(S) : Jiro Moriyama et al.

It is certified that error appears in the above-identified patent and that said Letters Patent is hereby corrected as shown below:

COLUMN 6

Line 23, "a" should read --an--
Line 29, "not shown in" should read --(not shown)--
Line 50, "side" should read --sides--
Line 59, "when" should read --during--
Line 63, "atmospheric air" should read --atmosphere--
Line 65, "phenomena" should read --phenomenon--.

COLUMN 7

Line 14, "atmospheric air." should read --atmosphere.--
Line 21, "down stream" should read --downstream--
Line 22, "fine sized" should read --fine-sized--
Line 33, "are" should read --is--
Line 38, "schematically" should read --schematic--
Line 43, "An" should read --A--
Line 54, "schematically" should read --schematic--.

COLUMN 8

Line 23, "schematically" should read --schematic--
Line 27, "schematically" should read --schematic--
Line 28, "cross-section" should read --cross-section in--
Line 38, "a" should read --an--
Line 43, "paths 63" should read --paths 61--
Line 45, "paths 63" should read --paths 61--.

UNITED STATES PATENT AND TRADEMARK OFFICE

CERTIFICATE OF CORRECTION

PATENT NO. : 5,457,485

DATED : October 10, 1995

INVENTOR(S) : Jiro Moriyama et al.

It is certified that error appears in the above-identified patent and that said Letters Patent is hereby corrected as shown below:

COLUMN 9

Line 7, "downstream" should read --downstream side--
Line 44, "4,45 9,600" should read --4,459,600--
Line 46, "to" should read --into--
Line 65, "consists" should read --consist--.

COLUMN 12

Line 11, "jet having" should read --jet unit having--.

Signed and Sealed this

Twenty-sixth Day of March, 1996

Bruce Lehman

*Attest:*

BRUCE LEHMAN

*Attesting Officer*

*Commissioner of Patents and Trademarks*